US007077757B1

(12) United States Patent
Payne et al.

(10) Patent No.: US 7,077,757 B1
(45) Date of Patent: Jul. 18, 2006

(54) CURVILINEAR GOLF CLUB-HEAD PATH ASSISTING INDICATOR AND METHOD

(76) Inventors: Brian Payne, 7424 Green Tree Dr., Orlando, FL (US) 32819; Mark Shaprow, 5085 Latrobe Dr., Windermere, FL (US) 34786

( * ) Notice: Subject to any disclaimer, the term of this patent is extended or adjusted under 35 U.S.C. 154(b) by 0 days.

(21) Appl. No.: 10/967,495

(22) Filed: Oct. 18, 2004

Related U.S. Application Data

(60) Provisional application No. 60/568,778, filed on May 6, 2004.

(51) Int. Cl.
*A63B 69/36* (2006.01)
*A63B 53/04* (2006.01)

(52) U.S. Cl. ..... 473/238; 473/242; 473/251; 473/249

(58) Field of Classification Search ..... 473/251–254, 473/238, 242, 409, 249; D21/746
See application file for complete search history.

(56) References Cited

U.S. PATENT DOCUMENTS

| | | | | | |
|---|---|---|---|---|---|
| 1,660,126 | A | * | 2/1928 | Heeter | 473/242 |
| D89,332 | S | * | 2/1933 | Bartsch | D21/733 |
| 2,842,369 | A | * | 7/1958 | East | 473/242 |
| 2,859,972 | A | * | 11/1958 | Reach | 473/242 |
| 2,934,347 | A | * | 4/1960 | Siniscalchi | 473/242 |
| 3,333,854 | A | * | 8/1967 | White | 473/288 |
| 3,680,860 | A | | 8/1972 | Elkins, Jr. | |
| 3,884,477 | A | * | 5/1975 | Bianco | 473/249 |
| 3,955,819 | A | | 5/1976 | Yokich | |
| D245,437 | S | * | 8/1977 | Thiel | |
| D251,027 | S | | 2/1979 | Cruger | |
| 4,174,839 | A | * | 11/1979 | Marrs | 473/252 |
| D264,367 | S | | 5/1982 | Gida | |
| 4,795,157 | A | * | 1/1989 | Bencriscutto | 473/251 |
| 4,805,922 | A | | 2/1989 | Whitfield | |
| 4,861,038 | A | | 8/1989 | Fucinato | |
| 4,872,684 | A | | 10/1989 | Dippel | |
| 4,913,438 | A | * | 4/1990 | Anderson | 473/253 |
| D368,292 | S | | 3/1996 | Willoughby | |
| D381,383 | S | | 7/1997 | Brett | |
| 5,692,969 | A | | 12/1997 | Schooler | |
| 5,746,664 | A | | 5/1998 | Reynolds, Jr. | |
| 5,984,800 | A | * | 11/1999 | Uebelhor | 473/251 |
| 6,409,610 | B1 | | 6/2002 | Ahn et al. | |

* cited by examiner

*Primary Examiner*—Sebastiano Passaniti
(74) *Attorney, Agent, or Firm*—Christine Q. McLeod; Beusse Wolter Sanks Mora & Maire

(57) ABSTRACT

The present invention provides a novel visual golf club-head curvilinear path indicator and method of use. Specifically, the present invention provides a visual golf club-head curvilinear path guide in the form of one or more alignment lines or markings on putters and other club-heads that are curvilinear (instead of linear) and that curve toward the golfer's body as he or she stands at address. The curvilinear line (or lines) and/or shape (or shapes) are intended to provide the golfer with a visual reminder to move the club-head back and through along a curvilinear path.

25 Claims, 3 Drawing Sheets

CURVILINEAR GOLF CLUB-HEAD PATH ASSISTING INDICATOR AND METHOD

CROSS-REFERENCE TO A RELATED APPLICATION

This application claims the benefit of U.S. Provisional Patent Application Ser. No. 60/568,778 filed May 6, 2004, incorporated herein by reference.

TECHNICAL FIELD OF THE INVENTION

The present invention relates to the field of golf, and more particularly, to the field of golf club-head path methods and techniques and a visual path indicator to promote same.

BACKGROUND OF THE INVENTION

Much has been done in golf club-head design in an effort to improve the performance of the golfer or otherwise enhance the golfing experience. Included in these efforts are methods and devices to assist golfers in proper aim to achieve consistent performance.

To achieve good results, many golfers find it desirable to have an alignment line ("sight line") on the top of the surface of golf club-heads, including putters, to aid in aiming the ball as precisely as possible. The typical alignment line consists of a straight line or groove perpendicular to the putter face located precisely at the center of gravity of the club-head. U.S. Pat. No. 3,680,860, discloses that: "Putters and other golf club-heads have been known in the prior art to have alignment lines or other sighting marks. These alignment lines have generally been provided for the purpose of aiding the golfer in visualizing what was considered to be a proper straight-line path from the ball to the cup or target hole. The golfer was instructed to view the alignment line and then draw an imaginary extension from that alignment line through the center of the ball to the target. He would then attempt to hit the ball with a true linear stroke exactly in the direction of the target line toward the target."

Other forms of alignment lines exist, including that described in U.S. Pat. No. 6,409,610, which includes both a perpendicular line and a curved horizontal face line which is an arc of a concentric circle of a golf ball placed abutting or one quarter of an inch in front of the hitting face of the putter. In all of these designs, however, the alignment line itself is a straight line intended to assist the golfer in aiming and swinging through on a linear path directly at the target. For those whose style dictates visualizing a pendulum style swing path, this form of sight line is generally acceptable. A number of patents provide for such sight lines, including U.S. Design Pat. Des. No. 264,367 to Gida and Des. No. 368,292 to Willoughby and U.S. Pat. No. 4,872,684 to Dippel. Other golfers rely upon multiple reference marks disposed on or around the club-head head in order to line up each shot. For instance, U.S. Pat. No. 4,805,922 to Whitfield; U.S. Pat. No. 4,861,038 to Fucinato and U.S. Pat. No. 5,692,969 to Schooler. Other clubs have been constructed having a central mark for aligning the putt and multiple other reference marks. For instance U.S. Design Pat. Des. No. 251,027 to Cruger, Des. No. 381,383 to Brett; U.S. Pat. No. 3,955,819 to Yokich show parallel white border grooves equidistant and on opposite sides of the red central groove and U.S. Pat. No. 5,746,664 Reynolds, Jr., claims a plurality of parallel sighting grooves disposed on the upper surface of the club-head.

For golfers who want to work not just on their aim, but also on their swing path or stroke, a number of training devices exist. Some may encourage a linear swing path, such as a simple string pulled taut between two posts under which a golfer may practice a straight back and through stroke. However, other devices exist which encourage a curvilinear club-head path. For example, a training device called "The Putting Arc" assists golfers on the practice ground in employing a swing path that curves in the same degree as the device. Golfers simply lay the device on the practice green directly adjacent to where they are stroking putts, and practice stroking along its curve. However, utilizing such a device on the course itself would be cumbersome and impractical, as well as in violation of the worldwide rules of golf as established by the United States Golf Association and the Royal and Ancient Golf Club of St. Andrews (See U.S.G.A. Rule 14-3). A similar putting aid is a device called the "Impact Trac" which is another visual tool laid on the surface of the green having a curved horizontal line to help the golfer guide a club-head through a curvilinear path in the hitting zone. A full swing aid along the same lines is a device called the Inside Approach endorsed by Jack Nicklaus, arguably the greatest golfer ever. This device is made of PVC Pipe that is partially covered by foam rubber. The device is placed next to the ball on the practice ground in such a manner that the golfer's club will strike the device if the golfer fails to swing the club-head on the proper curvilinear path.

The problem with the Inside Approach and other similar devices is that they are only training aids and cannot be used on the course during a regulation game, in addition to being too cumbersome and impractical to routinely take on the course. There clearly is a need in the art for a method and device to assist golfers during a regulation game in swinging the club-head on the proper curvilinear path. Currently existing sightlines do not follow a curvilinear path and therefore provide no help in visualizing and executing a curvilinear swing path. In fact, currently existing linear sightlines may actually distract from the natural and desirable tendency of golfers to swing along a curvilinear path. Thus, the present invention is designed to fill the need in the art for a method and device to assist golfers during a regulation game in swinging on the proper curvilinear path.

SUMMARY OF THE INVENTION

The present invention provides a novel visual golf club-head curvilinear path indicator and method of use. Specifically, the present invention provides a visual golf club-head curvilinear path guide in the form of one or more alignment lines or markings on putters and other club-heads that are curvilinear (instead of linear) and that curve toward the golfer's body as he or she stands at address. This also includes the club-head or putter-head itself extending back in such curvilinear fashion. The present invention is based on the premise that the golfer is best served not by an alignment line that encourages a "true linear stroke exactly in the direction of the target line toward the target" as described in U.S. Pat. No. 3,680,860, but rather by a curvilinear path assisting marking that encourages a curvilinear stroke or swing by the golfer, specifically one where the club head curves toward the body on the back swing, approaches the ball from the inside on the downswing, and again curves toward the body on the follow through. The present invention could be used in conjunction with a linear alignment line, or without such a line, but in either event it would require one or more curvilinear alignment lines or shapes to assist the golfer in swinging along the proper curvilinear path. In his classic instructional book, *Golf My Way*, Jack Nicklaus notes on page 106 that "Many golfers get confused about the line along which the club-head should start back, particularly when they have been made conscious of 'hitting from the inside.'" Decades of golf clubs being available only with linear alignment lines or no alignment lines whatsoever have not helped the situation. The curvilinear line (or lines) of the present invention which curves toward the body of the golfer while holding the club-head at address is intended to eliminate or lessen the golfer's confusion by providing the golfer with a visual reminder to move the club-head back and through along a curvilinear path. A linear alignment line sends a dramatically different visual message to the golfer as it relates to his or her swing path. The difference between using a golf club with a curvilinear path line versus one with only a linear sightline will provide significant performance benefits for amateurs and professionals alike.

Specifically, the invention comprises a visual golf club-head curvilinear path indicator in the form of at least one curvilinear groove or line marking formed in the upper surface of the golf club-head and acting as a sighting aid and swing path guide means. In a preferred embodiment, a golf club of the present invention includes an elongated shaft having a player gripping end and a club-head end; and a club-head extending from the club-head end, the club-head having a heel, a toe, a sole and a top and a striking face there between, the club-head including indicia in the form of at least one curvilinear shape, groove, or line marking formed in the upper surface of the club-head and acting as a sighting aid and swing path guide means. The visual path indicator may curve in different degrees, based on a combination of the visual preferences of golfers generally, the visual preferences of golfers individually, and/or the lie angle of the club-head, with flatter lie angles warranting more curvature. This invention does not encompass all curvilinear representations on club-heads; rather it encompasses only those that curve toward the body of the golfer in order to assist the golfer in visualizing and producing the desired curvilinear swing path.

A method of the present invention includes sighting a golf shot utilizing a golf club-head having the curvilinear indicia of the present invention. Other features and objects of the invention will be apparent from the following description of the invention and its embodiments. All references, including publications, patent applications, and patents, cited herein are hereby incorporated by reference to the same extent as if each reference were individually and specifically indicated to be incorporated by reference and were set forth in its entirety herein.

BRIEF DESCRIPTION OF THE DRAWINGS

For clarity, the following nomenclature, adapted from the prior art, will be employed in the description. The ball striking surface or "strike face" of the club-head, which is intended to hit the golf ball, is located on the "front" of the club-head. The terms "top" or "upper" and "bottom" or "lower" assume that the club-head is oriented as it would be if the golf club-head were held by a golfer in an at rest position, i.e., the bottom of the club-head, also called the sole, would contact the ground when at rest. The heel of the club-head is located longitudinally opposite the toe of the club-head. The heel portion of the club-head would be nearest the golfer when the golfer holds the club-head in an at rest position. The term "depth" refers to a dimension extending from the front to the back of the golf club-head. The terms "length" of the club-head and "longitudinal" refer to a dimension extending from the heel end to the toe end.

DESCRIPTION OF THE INVENTION

Figure 1:
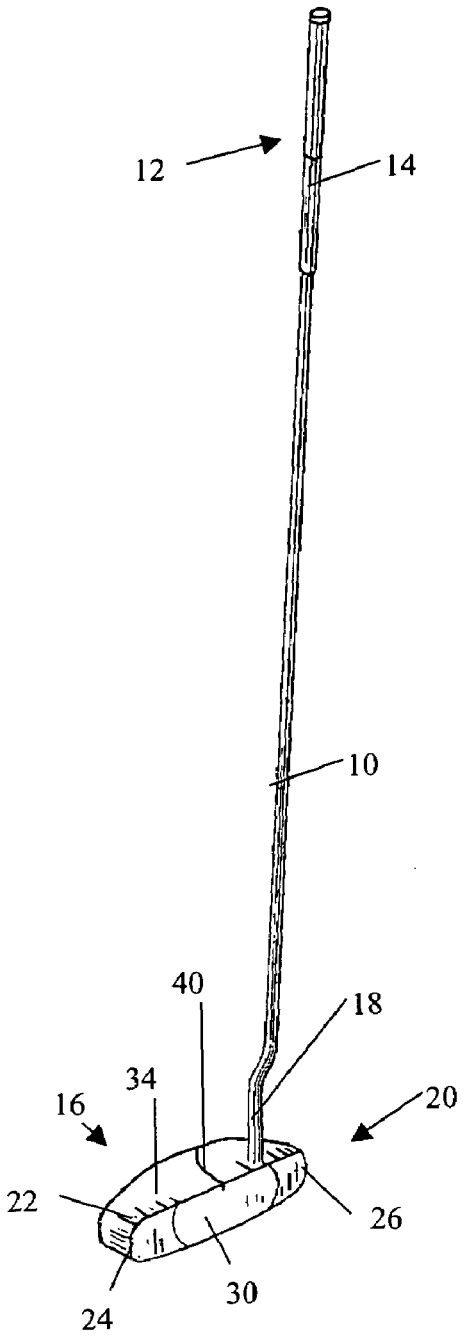
FIG. 1 is an overview perspective of a club-head embodying an example of the invention including curvilinear indicia.

Referring now to the drawings and more particularly to FIG. 1, a perspective view of a typical golf club-head (including putters, drivers, fairway metals, and the like) is shown comprising generally a shaft 10 having a gripping end 12 with a handle 14 and a club-head end 16 that has a connecting means 18 in the nature of a hosel integrated with the club-head 20. The club-head 20 has a central body 22 with a shell having a heel end 24 and a toe end 26. The construction of the shaft, hosel, and club-head are well known in the art. For example, the shaft 10, hosel 18, and club-head 20 may be of a metal (such as steel or tungsten), metal alloy, composite material such as a graphite resin composite, or a fiberglass resin composite or other materials dictated by the regulations of the USGA or other regulatory organizations. The front or striking surface 30 (sometimes referred to as an "insert") of body 22 extends longitudinally from the club-head between the front surfaces of heel end 24 and toe end 26 of a club-head 20 which together comprise the striking face. The upper surface 34 of body 22 includes indicia 40 that, in the preferred embodiment, comprise at least one curvilinear groove/line or marking formed in the upper surface transverse to the striking surface 30. The groove acts as a sighting aid and swing path guide means and is located above an optimum target point (not shown) on the striking surface 30.

Figure 2:
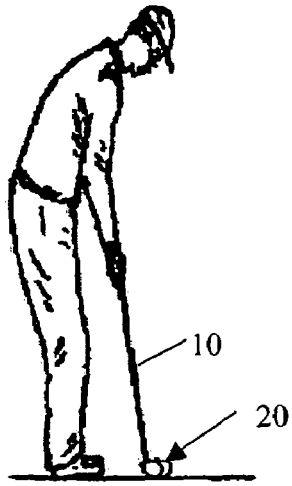
FIG. 2 is a perspective view of a golfer using a club-head embodying an example of the invention including curvilinear indicia.

FIG. 2 is a perspective view of a golfer using a putter embodying an example of the invention including curvilinear indicia. The golfer views the curvilinear indicia on the club-head, which assists him with proper swing technique.

Figure 3:
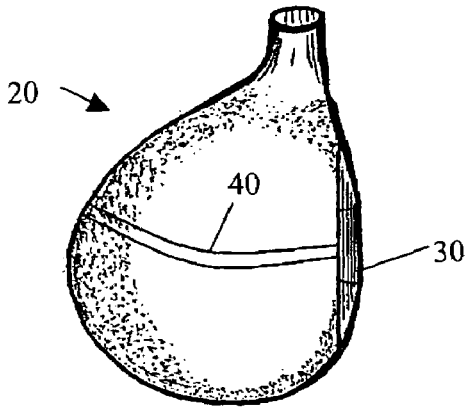
FIG. 3 is a top perspective view of a club-head of one embodiment of the invention including curvilinear indicia.
Figure 4:
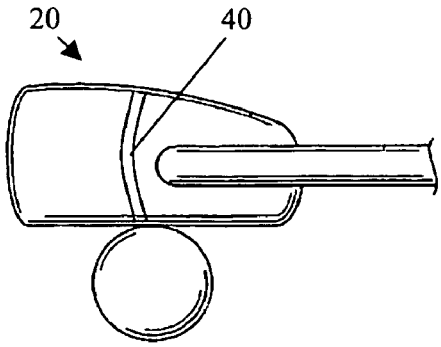
FIG. 4 is a top plan view of the club-head of another embodiment of the invention including curvilinear indicia.
Figure 5:
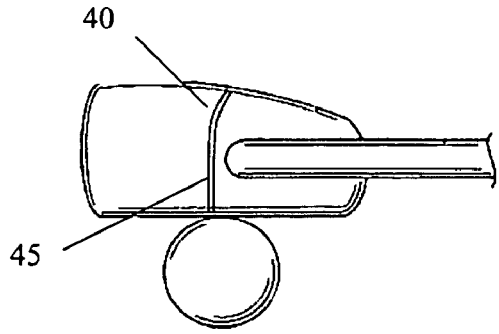
FIG. 5 is a top plan view of the club-head of another embodiment of the invention including a linear sight line beginning at the face of the club and extending into a curvilinear line.
Figure 6:
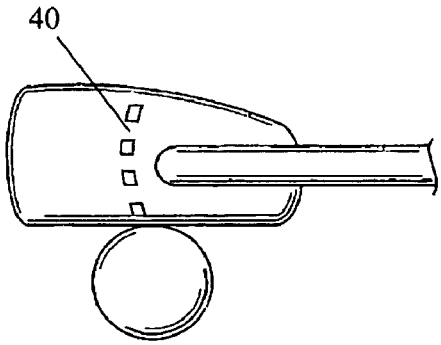
FIG. 6 is a top plan view of the club-head of another embodiment of the invention including curvilinear indicia in the form of a dashed line.
Figure 7:
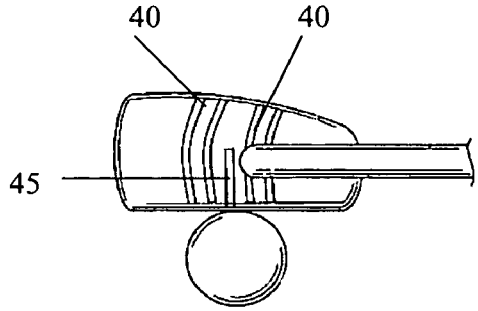
FIG. 7 is a top plan view of the club-head of another embodiment of the invention including curvilinear indicia as well as a linear sight line.
Figure 8:
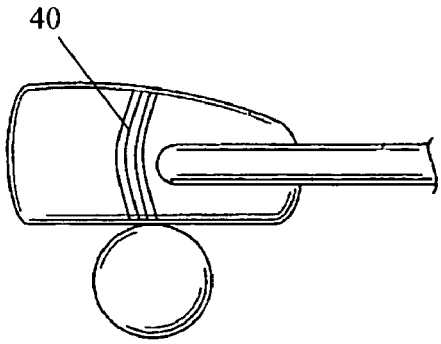
FIG. 8 is a top plan view of the club-head of another embodiment of the invention including curvilinear indicia.

FIG. 3 is a top perspective view of a club-head of one embodiment of the invention including curvilinear indicia. FIGS. 4–8 are top plan views of the club-head in other embodiments of the invention including curvilinear indicia. Specifically, FIG. 4 shows a single curvilinear line. FIG. 5 shows a linear sight line 45 beginning at the face of the club and extending into a curvilinear line 40. FIG. 6 shows curvilinear indicia 40 in the form of a dashed line. FIG. 7 shows curvilinear indicia 40 as well as a linear sight line. FIG. 8 shows double curvilinear lines 40.

Figure 9:
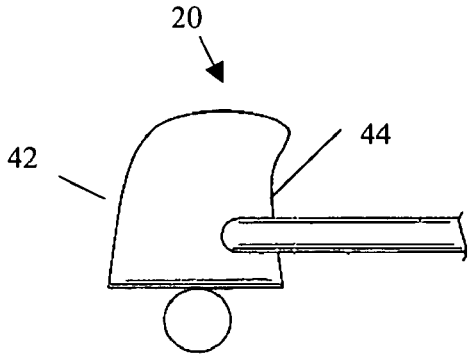
FIG. 9 is a top plan view of the club-head of another embodiment of the invention wherein the club-head itself is curvilinear in shape as viewed from the upper surface.
Figure 10:
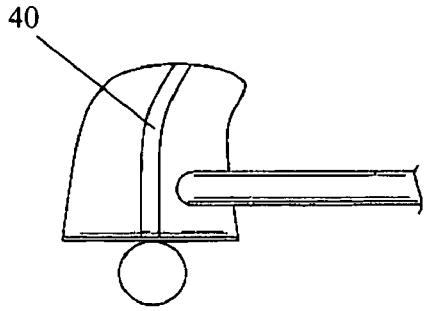
FIG. 10 is a top plan view of the club-head of another embodiment of the invention wherein the club-head itself is curvilinear in shape as viewed from the upper surface and includes curvilinear indicia.

FIG. 9 is an illustration of a club-head 20 wherein the head itself is curvilinear in shape. The surfaces 42 and 44 form the curvilinear indicia. There is no requirement that the surfaces 42 and 44 have the same contour or radius of curvature. Likewise, FIGS. 10–13 are illustrations of a club-heads 20 that are curvilinear in shape and also have a curvilinear indicia 40 arranged on the upper surface of the club-heads 20. The curvilinear indicia 40 in each of these figures is intended to apply whether or not the club-head itself is curvilinear.

Figure 11:
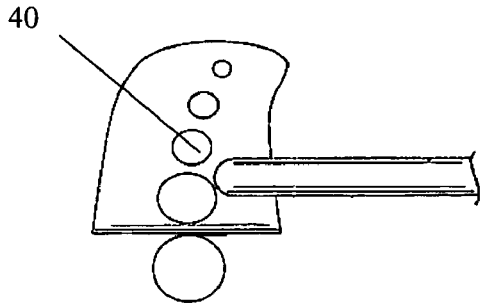
FIG. 11 is a top plan view of the club-head of another embodiment of the invention wherein the club-head itself is curvilinear in shape as viewed from the upper surface and includes curvilinear indicia in the form of small circles.
Figure 12:
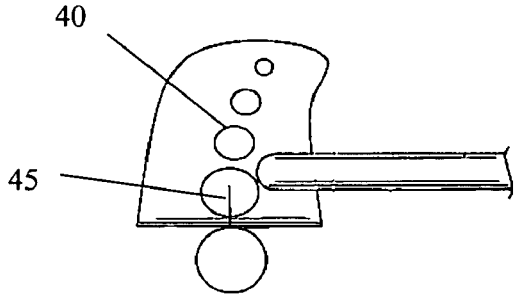
FIG. 12 is a top plan view of the club-head of another embodiment of the invention wherein the club-head itself is curvilinear in shape as viewed from the upper surface and includes curvilinear indicia in the form of small circles as well as a linear sight line.
Figure 13:
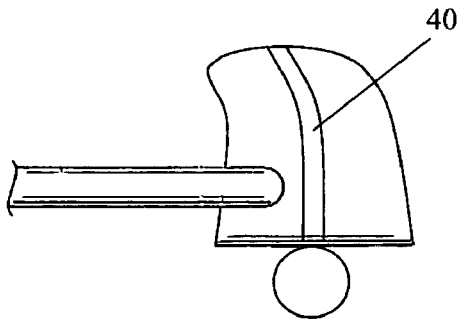
FIG. 13 is a top plan view of a left-handed club-head of another embodiment of the invention wherein the club-head itself is curvilinear in shape as viewed from the upper surface and includes curvilinear indicia.

FIG. 11 illustrates an embodiment of the present invention having circular shaped indicia 40 as the curvilinear sightline. The circular shaped indicia extend transverse to the striking surface toward the rear of the club-head 20 forming the curvilinear line of sight. FIG. 12 is similar to FIG. 11 except it also includes a linear sight line 45 in addition to the curvilinear lines 40. FIG. 13 illustrates an embodiment of the instant invention for use with a left-handed club-head 20.

There is a wide range of golf putter and club-head styles including relatively small blades to more massive mallets. Consequently, the depth of the club-head along the top face 34 of body 22 also varies. One skilled in the art can apply the invention to most styles.

The indicia 40, in the preferred embodiment, comprise at least one curvilinear groove or alignment line formed in the upper surface transverse to the striking surface 30. The indicia 40 acts as a sighting aid and swing path guide means. The indicia 40 may traverse the entire top surface of the upper surface, terminating at the striking surface. Alternately, the indicia 40 may traverse only a portion of the upper surface. In a preferred embodiment, the indicia 40 comprise a single line of sufficient width to be visualized by the golfer. Alternately, the indicia 40 comprise a plurality of lines. The plurality of lines may be of the same or different colors, widths, and lengths. Other curvilinear representations are also contemplated herein, not necessarily lines. For example, the curvilinear shape may be represented by a curved representation of dots, dashes, circles, spheres, arrows, or the like. Such representation may be two- or three-dimensional, but they curve toward the body of the golfer. Some alternative forms of the indicia 40 are shown as examples in the figures. FIGS. 5, 7 and 12 represent alternative forms of the indicia 40 used in conjunction with traditional linear alignment lines.

In accordance with the preferred embodiment, the indicia 40 curve toward the body on the backswing path and again toward the body on the follow-through. Different curvature degrees may be represented by different coloring schemes or indicia. With this invention, golfers will no longer be limited to viewing alignment lines extending straight back from the club-head face in linear fashion. Golfers who prefer to view a path assisting curvilinear line will benefit from the indicia 40 of the present invention.

The indicia 40 may be formed by painting or otherwise marking a curvilinear line on the top of the club-head. Or, it may be formed by scoring a curvilinear line in the top of the club-head 20. Moreover the scored line may be filled in with desired color paint. The indicia may also be formed by a raised groove or other means to visually indicate the curvilinear line. Generally, the indicia 40 are characterized by a curvilinear line(s) having a curve as defined above. It should be noted that the primary purpose of the indicia 40 is to assist the golfer in swinging the club-head along a curvilinear path. Accordingly, the indicia 40 must be clearly visible to the golfer as he looks down on the club-head 20. Thus, the indicia 40 may be formed by a raised portion, a sunken portion, or an otherwise contoured portion which may or may not require coloring in order to be easily visualized by the golfer. It is preferable that the indicia be formed in accordance with the rules of golf so that it may be used during regulated games. The club-head itself may be shaped such that its upper surface has a curvilinear shape.

The present invention conforms to the rules of golf, the only rules question being as to adjustable sightlines. Under the current rules of golf, club-heads may not be adjusted during rounds. However, if permitted under the rules, this invention would encompass curvilinear path assisting lines or markings adjustable between rounds. For example, the lines or markings may be adjusted with removable upper surfaces, each having a curvilinear path assisting line or marking with a slightly different degree of curve.

This invention will help sighted golfers of all types, whether right or left handed, man or woman, child or senior, beginner or professional. This invention will provide golfers as they address the ball on the course itself with a visual reminder to stroke or swing their club-head on a curvilinear path. By improving visualization of the desired curvilinear swing path, the present invention will provide users with the opportunity for significant performance benefits. Moreover, the novel visual golf club-head curvilinear path indicator and method of use will conveniently enable users during regulation play to correct the undesirable outside-in swing path that plagues most golfers.

The use of the terms "a" and "an" and "the" and similar references in the context of describing the invention are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Of course, variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A golf club putter for use in putting to encourage a curvilinear swing path, comprising:

a shaft having a gripping end with a handle;

a putter head associated with the shaft, comprising:

a central body having a heel end, a toe end, and an upper surface;

a front striking surface of the central body extending from the putter-head between the front surfaces of the heel end and toe end; and a curvilinear indicia of sufficient width to be viewed by the user, formed on the upper surface transverse to the striking surface arranged beginning substantially at or near the front striking surface and extending as an are having a single radius of curvature along all or part of the depth of the putter-head toward the back of the putter-head such that the curvilinear indicia curves toward the body of the user when standing at address and wherein said upper surface excludes any curvilinear indicia that curves away from the body of the user, the indicia effective to encourage a user to use a curvilinear swing path.

2. The golf club putter as claimed in claim 1, wherein the club-head is selected from the group of club-heads consisting of a plurality of putters.

3. The golf club putter as claimed in claim 1, wherein the curvilinear indicia functions as an aid to assist the user in visualizing and producing the proper swing path and is located above or in relation to an optimum target point on the front striking surface.

4. The golf club putter as claimed in claim 1, wherein the curvilinear indicia is used in conjunction with a linear alignment indicia also located on the upper surface of the central body.

5. The golf club putter as claimed in claim 2, wherein the curvilinear indicia is an arc that curves toward the body of the user when standing at address.

6. The golf club putter as claimed in claim 1, wherein the curvilinear indicia is a compound are comprised of two or more connected or unconnected arcs that curve toward the body of the user when standing at address having the same radius of curvature.

7. The golf club putter as claimed in claim 5, wherein a plurality of curvilinear indicia are arranged on the upper surface of the central body such that the curvilinear indicia curve toward the body of the user when standing at address.

8. The golf club putter as claimed in claim 7, wherein the plurality of curvilinear indicia are of the same or different lengths, of the same or different colors, of the same or different widths.

9. The golf club putter as claimed in claim 7, wherein the curvilinear indicia are selected from one or more of an arc, a compound arc, a curved representation of dots, a curved representation of dashes, a curved representation of triangles, a curved representation of circles or partial circles, a curved representation of spheres, a curved representation of arrows, or a carved representation of geometric shapes, all that arc toward the body of the user while standing at address.

10. The golf club putter as claimed in claim 7, wherein the plurality of indicia curve open toward the user in different degrees or have different radii of curvature.

11. The golf club putter as claimed in claim 7, wherein the curvilinear indicia may be formed by one or more of a raised portion, a sunken portion, an otherwise contoured portion able to visualized by the user.

12. The golf club putter as claimed in claim 7, wherein the curvilinear indicia are adjustable or removable.

13. The golf club putter as claimed in claim 1, wherein the curvilinear indicia results from the shape of the club-head itself such that the upper surface thereof is curvilinear such that the curvilinear indicia curves toward the body of the user when standing at address.

14. A golf club putter head for use in putting to encourage a curvilinear swing path, comprising:

a central body having a heel end, a toe end, and an upper surface;

a front striking surface of the central body extending from the club-head between the front surfaces of the heel end and toe end; and a curvilinear indicia of sufficient width to be viewed by the user, formed on the upper surface transverse to the striking surface arranged beginning substantially at or near the front sinking surface and extending as an arc having a single radius of curvature alone all or pan of the depth of the putter-head toward the back of the putter-head such that the curvilinear indicia curves toward the body of the user when standing at address and wherein said upper surface excludes any curvilinear indicia that curves away from the body of the user, the indicia effective to encourage a user to use a curvilinear swine path.

15. The putter-head as claimed in claim 14, wherein the curvilinear indicia is used in conjunction with a linear alignment indicia also located on the upper surface of the central body.

16. The putter-head as claimed in claim 14, wherein the curvilinear indicia is an arc that curves toward the body of the user when standing at address.

17. The putter-head as claimed in claim 16, wherein a plurality of curvilinear indicia are arranged on the upper surface of the central body such that the curvilinear indicia curve toward the body of the user when standing at address.

18. The putter-head as claimed in claim 17, wherein the curvilinear indicia are selected from one or more of an arc, a compound arc, a curved representation of dots, a curved representation of dashes, a curved representation of triangles, a curved representation of circles or partial circles, a curved representation of spheres, a curved representation of arrows, or a curved representation of geometric shapes, all that arc toward the body of the user while standing at address.

19. The putter-head as claimed in claim 17, wherein the curvilinear indicia may be formed by one or more of a raised portion, a sunken portion, an otherwise contoured portion able to visualized by the user.

20. The putter-head as claimed in claim 17, wherein the curvilinear indicia are adjustable.

21. The putter-head as claimed in claim 17, wherein the curvilinear indicia are formed on the upper surface with one or more of a paint, a tape, by an etching operation, by placing a groove on the upper surface.

22. The putter-head as claimed in claim 14, further comprising a shaft having a first end with a handle and a second end associated with the club-head.

23. The putter-head as claimed in clam 14, wherein the club-head has surfaces that are curvilinear in shape and form the curvilinear indicia.

24. A method for using a golf club putter when putting to encourage a curvilinear swing path having a curvilinear indicia arranged on an upper surface of a putter-head beginning substantially at or near the front striking surface and extending as an arc having a single radius of curvature along all or part of the depth of the putter-head toward the back of the putter-head wherein the curvilinear indicia curves toward the body of the user when standing at address and wherein said upper surface excludes any curvilinear indicia that curves away from the body of the user, comprising;

setting up to a golf ball;

aligning the golf club with the golf ball and a target;

checking or conforming the set up alignment to the ball;

using the curvilinear indicia to guide the golfer in swinging the putter-head back and through on the desired curvilinear path.

25. The method as claimed in claim 24, wherein the golf club putter has a plurality of curvilinear indicia arranged on the upper surface of the putter-head such that the curvilinear indicia curve toward the body of the user when standing at address.

* * * * *